US008720346B2

(12) United States Patent
Shinmura et al.

(10) Patent No.: US 8,720,346 B2
(45) Date of Patent: May 13, 2014

(54) BOGIE FRAME FOR RAILROAD VEHICLE

(75) Inventors: Hiroshi Shinmura, Toyokawa (JP); Daizo Kanaya, Toyokawa (JP); Yasuyuki Fukui, Toyokawa (JP); Yuki Kunimatsu, Toyohashi (JP); Shotaro Ozu, Toyokawa (JP); Yoshitomo Watanabe, Nagoya (JP); Takehiro Tozawa, Toyohashi (JP); Koichi Yamada, Nagoya (JP); Junichi Ishiyama, Nagoya (JP)

(73) Assignees: Nippon Sharyo, Ltd., Aichi (JP); Central Japan Railway Company, Aichi (JP)

( * ) Notice: Subject to any disclaimer, the term of this patent is extended or adjusted under 35 U.S.C. 154(b) by 5 days.

(21) Appl. No.: 13/578,495

(22) PCT Filed: Jul. 8, 2010

(86) PCT No.: PCT/JP2010/061584

§ 371 (c)(1),
(2), (4) Date: Aug. 10, 2012

(87) PCT Pub. No.: WO2011/099179

PCT Pub. Date: Aug. 18, 2011

(65) Prior Publication Data

US 2012/0318164 A1 Dec. 20, 2012

(30) Foreign Application Priority Data

Feb. 15, 2010 (JP) ..... 2010-030466

(51) Int. Cl.
*B61F 5/52* (2006.01)
*B61C 17/00* (2006.01)

(52) U.S. Cl.
CPC .. *B61F 5/52* (2013.01); *B61C 17/00* (2013.01)
USPC ..... 105/172; 105/182.1; 105/226; 105/34.1

(58) Field of Classification Search
CPC ..... B61F 5/52; B61F 5/523
USPC ..... 105/182.1, 200, 202, 204, 205, 206.1, 105/208, 226, 227, 230, 172, 34.1
See application file for complete search history.

(56) References Cited

U.S. PATENT DOCUMENTS 408,024 A * 7/1889 Hughes ..... 105/206.1
1,275,340 A * 8/1918 Westlake ..... 105/179

(Continued)

FOREIGN PATENT DOCUMENTS

CH 444216 9/1967
DE 1530146 A1 6/1969

(Continued)

OTHER PUBLICATIONS

Extended European Search Report dated Jul. 24, 2013 for counterpart European Patent Application No. 10 84 5771.

*Primary Examiner* — Mark Le
(74) *Attorney, Agent, or Firm* — Sughrue Mion, PLLC

(57) ABSTRACT

In a bogie frame, a lateral beam disposed in the left-right direction which is the direction in which the rail ties extend is joined to left and right side beams arranged so as to extend in the front-rear direction which is the direction in which the rails extend. The lateral beam has a flat shape having a width in the front-rear direction greater than the thickness thereof in the top-bottom direction, and the lateral beam is provided with left and right joining sections joined to the side beams, and also with an intermediate section sandwiched between the left and right joining sections. The width of the intermediate section in the front-rear direction is greater than the width of the joining sections in the front-rear direction. A through-hole is formed in the intermediate section.

18 Claims, 12 Drawing Sheets

(56) References Cited

U.S. PATENT DOCUMENTS

| | | | | | |
|---|---|---|---|---|---|
| 1,410,979 | A | * | 3/1922 | Westlake | 105/197.05 |
| 3,338,183 | A | | 8/1967 | Bossier | |
| 3,352,255 | A | * | 11/1967 | Sheppard | 105/198.7 |
| 6,601,520 | B2 | * | 8/2003 | Eche et al. | 105/34.1 |
| 8,474,383 | B1 | * | 7/2013 | Berg et al. | 105/208 |

FOREIGN PATENT DOCUMENTS

| | | | | |
|---|---|---|---|---|
| DE | 1530153 | A1 | | 3/1972 |
| EP | 1340661 | A1 | | 9/2003 |
| FR | 2381651 | A1 | | 9/1978 |
| GB | 1029192 | A | | 5/1966 |
| JP | 3-050066 | A | | 3/1991 |
| JP | 4-173473 | A | | 6/1992 |
| JP | 11-20693 | | * | 1/1999 |
| JP | 11-020693 | A | | 1/1999 |
| JP | 2000-085579 | A | | 3/2000 |
| JP | 2001-080512 | A | | 3/2001 |
| JP | 2003-025989 | A | | 1/2003 |
| JP | 2006-15820 | A | | 1/2006 |
| JP | 2008-055952 | A | | 3/2008 |
| WO | 2008/070953 | A1 | | 6/2008 |

* cited by examiner

BOGIE FRAME FOR RAILROAD VEHICLE

CROSS REFERENCE TO RELATED APPLICATIONS

This application is a National Stage of International Application No. PCT/JP2010/061584 filed on Jul. 8, 2010, which claims priority from Japanese Patent Application No. 2010-030466, filed on Feb. 15, 2010, the contents of all of which are incorporated herein by reference in their entirety.

TECHNICAL FIELD

The present invention relates to a bogie frame for railroad vehicle including side beams and lateral beams joined to each other so that devices such as a motor, a unit brake, and others are mounted on the lateral beams.

BACKGROUND ART

A bogie frame for railroad vehicle includes two, right and left, side beams arranged to extend in a rail direction (a front-rear direction of the bogie frame) and two, front and rear, lateral beams arranged to extend in a rail-tie or sleeper direction (a right-left direction of the bogie frame), the side beams and the lateral beams being joined to each other. Conventionally, various configurations are proposed for the bogie frame for railroad vehicle having such a shape. For example, FIG. 15 shows a bogie frame for railroad vehicle disclosed in Patent Document 1 listed below. A bogie frame 100 for railroad vehicle includes side beams 101 each having spring caps 111 at both ends in a front-rear direction and two lateral beams 102 extending through the side beams 101 and being welded thereto in respective penetrating portions. The lateral beams 102 are made of round steel pipes. Two lateral beams 102 are integrally configured with top plates 112 and bottom plates 113.

Furthermore, Patent Document 2 listed below discloses a bogie frame including lateral beams and side beams configured as a vertically two-divided structure. This bogie frame for railroad vehicle consists of an upper frame and a lower frame, each having a recessed cross-section formed by press molding, the upper and lower frames being made integral by welding. Furthermore, Patent Document 3 listed below also discloses a side beam for use in a bogie frame for railroad vehicle. The side beam is made of a long flat plate by press work.

RELATED ART DOCUMENTS

Patent Documents

Patent Document 1: JP 2006-15820 A
Patent Document 2: JP 2000-85579 A
Patent Document 3: JP 2001-80512 A

DISCLOSURE OF THE INVENTION

Problems to be Solved by the Invention

Conventional bogie frames for railroad vehicle, not only those disclosed in the aforementioned Patent Documents, are generally designed with substantially the same shape in plan view. That is, two straight lateral beams are joined to right and left side beams arranged in parallel, thus taking a shape like "#". In the bogie frame for railroad vehicle having such a shape, however, devices such as a motor 121 and a unit brake

123 placed in positions as shown in FIG. 16 have the following problems in their mounting states.

For example, the motor 121 and the gear unit 122 to rotate an axle 131 are preferably placed near the axle 131. It is therefore necessary to place the motor 121 far from the lateral beams 102. To mount the motor 121, a bracket 135 is used to place the motor 121 apart from the lateral beam 102. On the other hand, the unit brake 123 is mounted between a wheel 132 and the lateral beam 102. However, a space between the wheel 132 and the lateral beam 102 is narrow and hence the unit brake 123 is placed very close to the lateral beam 102. To enable placement in such a narrow space, the unit brake 123 is processed so that its main body includes a recess to avoid the lateral beam 102.

Accordingly, the conventional bogie frame for railroad vehicle needs special mounting structures designed according to respective devices. Further, in the case where the lateral beam 102 is made of a round steel pipe, it is difficult to weld the bracket 135 and others to the lateral beam 102, resulting in a troublesome work. The above problems may also cause increased costs of railroad vehicles. Furthermore, due to the shape of a processed main body of the unit brake 123, the unit brake 123 loses flexibility of in a vertical direction when the unit brake 123 is mounted. In addition, the lateral beam made of a steel pipe could not be internally added with a reinforcing material or member. Thus, strength of this lateral beam could not be increased.

The present invention has been made to solve the above problems and has a purpose to provide a bogie frame for railroad vehicle enabling easy mounting of devices thereon.

Means of Solving the Problems

To achieve the above purpose, one aspect of the invention provides a bogie frame for railroad vehicle, wherein a single lateral beam placed to extend in a left-right direction along a rail-tie so that a motor and brakes are to be mounted on the lateral beam is joined to right and left side beams arranged to extend in a front-rear direction along a rail, the lateral beam includes right and left joining sections joined to the side beams by penetrating through the side beams and an intermediate section provided between the joining sections, each of the joining sections and the intermediate section having a flattened shape having a width in the front-rear direction larger than a thickness in a top-bottom direction, the intermediate section being formed with an oblong through hole at a center, each joining section has curved end faces located in the front-rear direction, and the intermediate section has flat end faces located in the front-rear direction and a flat wall defining the through hole, and the intermediate section is formed to be wider in the front-rear direction than the joining section to avoid the necessity of adjusting a position of the motor in the front-rear direction with a bracket when the motor is to be mounted on the intermediate section and coupled to an axle through a gear unit, and the joining sections have a size in the left-right direction to allow mounting of the brakes inside the side beams.

In the bogie frame for railroad vehicle, preferably, the lateral beam is configured such that each joining section has a thickness in the top-bottom direction smaller than that of the intermediate section.

In the bogie frame for railroad vehicle, preferably, the lateral beam has upper and lower surfaces each changing through shoulder portions each sloping from the intermediate section to the joining sections so that the upper surface and the lower surface are symmetric.

In the bogie frame for railroad vehicle, preferably, the lateral beam has upper and lower surfaces, one of the surfaces changing through shoulder portions each sloping from the intermediate section to the joining sections so that the upper surface and the lower surface are asymmetric.

In the bogie frame for railroad vehicle, preferably, each joining section has end portions in the front-rear direction, each end portion being formed as a circular portion having a diameter larger than the thickness of the intermediate section.

In the bogie frame for railroad vehicle, preferably, the lateral beam is formed with sloping shoulder portions between the intermediate section and the joining sections so that the intermediate section and the joining sections are different in height in the top-bottom direction.

In the bogie frame for railroad vehicle, preferably, the lateral beam includes a pair of lateral-beam members made of steel plates by press molding, the lateral-beam members being configured as two parts separated in the front-rear direction or in the top-bottom direction and integrally joined to each other by welding.

In the bogie frame for railroad vehicle, preferably, a partition plate is welded to the lateral-beam member, and auxiliary air chambers for air springs to be placed on right and left sides.

Effects of the Invention

According to the invention, the lateral beam is designed such that the intermediate section is larger in width in the front-rear direction than the joining section. Thus, the bogie frame for railroad vehicle enables easy mounting of devices. For example, the intermediate section allows mounting of a motor in a position near an axle, while the joining section provides a wide space in which a unit brake is placed between the joining section and a wheel.

DESCRIPTION OF THE REFERENCE SIGNS

Figure 1:
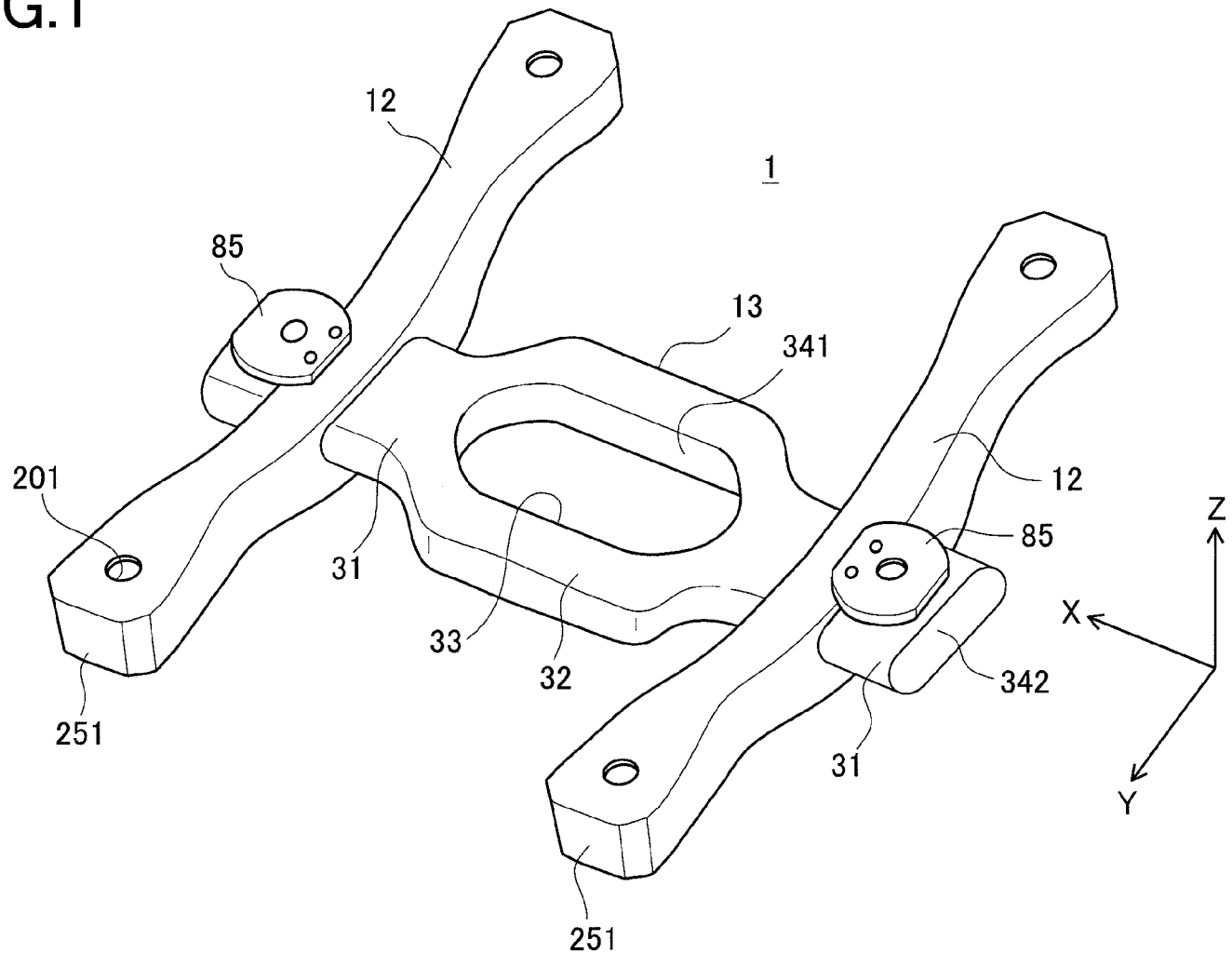
FIG. 1 is a perspective view of a bogie frame for railroad vehicle in a first embodiment.

1 Bogie frame for railroad vehicle
12 Side beam
13 Lateral beam
30 Lateral-beam member
31 Joining part
32 Intermediate part
33 Through hole

MODE FOR CARRYING OUT THE INVENTION

A detailed description of a preferred embodiment of a bogie frame for railroad vehicle (hereinafter, simply referred to as a "bogie frame") embodying the present invention will now be given referring to the accompanying drawings. FIG. 1 is a perspective view of the bogie frame in the first embodiment. This bogie frame 1 is configured such that two side beams 12 arranged to extend in parallel in a rail direction, a lateral beam 13 arranged to extend in a rail-tie or sleeper direction and penetrate through the side beams 12, and the side beams 12 and the lateral beam 13 are welded to each other in the penetrating portions. In the figures, a Y axis direction represents a front-rear direction of the bogie frame, corresponding to the rail direction, and an X axis direction represents a left-right direction of the bogie frame 1, corresponding to the rail-tie or sleeper direction.

The bogie frame 1, different from the conventional example using two pipes, includes the lateral beam 13 configured as a single component. The lateral beam 13 is designed to be larger in a width direction, i.e., in the front-rear direction of the bogie frame 1, than in a thickness direction and to have a flattened shape in section when seen in a longitudinal direction (the X direction in the figure). The lateral beam 13 includes right and left joining sections 31 penetrating through the side beams 12 and an intermediate section 32 having an oblong through hole 33. Each joining section 31 has an oblong cross-section and a predetermined width. The intermediate section 32 is formed to be wider than the joining section 31 and protrude in the front-rear direction (the Y axis direction) as shown in FIG. 1.

Figure 2:
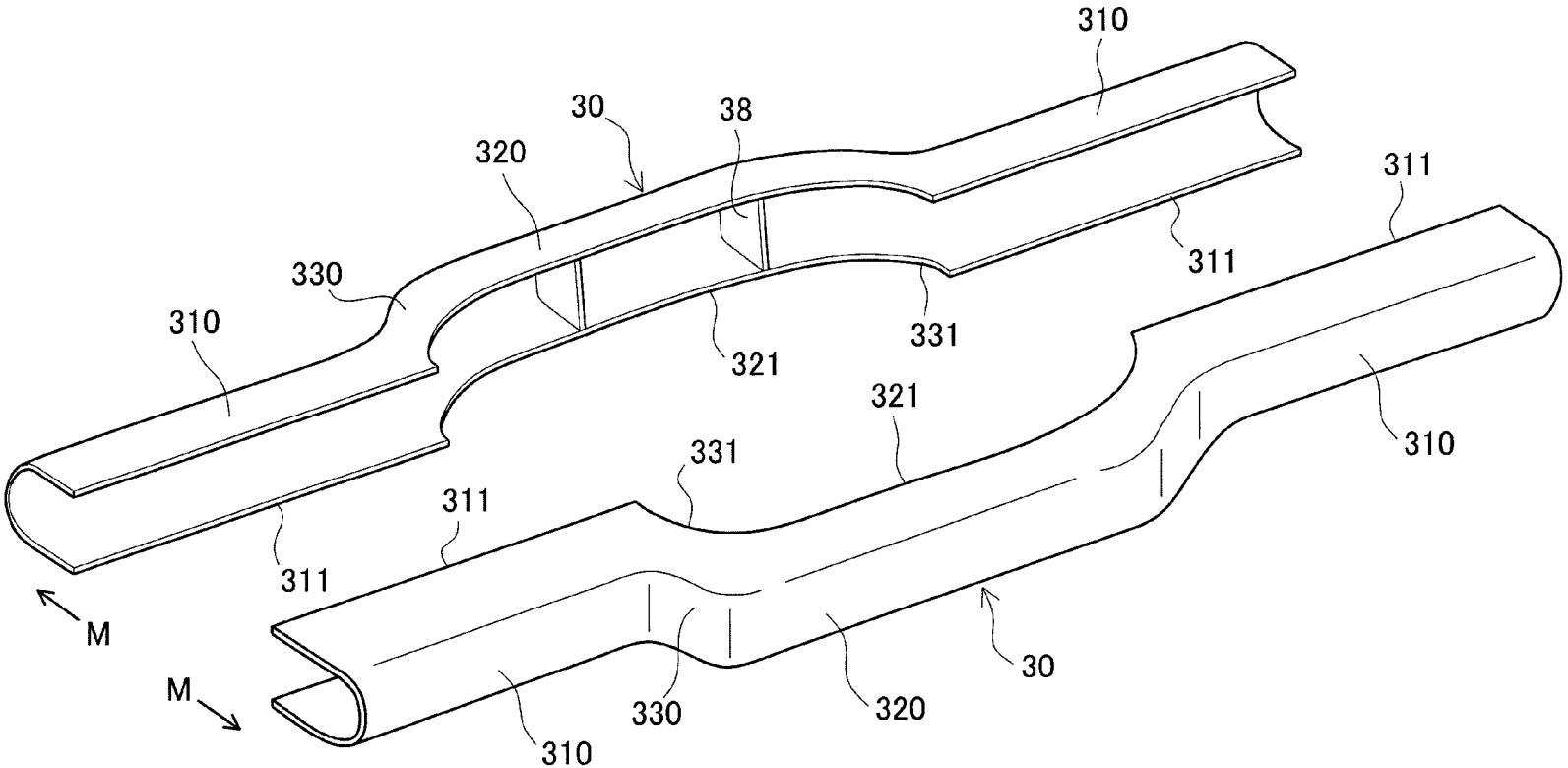
FIG. 2 is a perspective view of a first workpiece pattern of a lateral beam of the bogie frame for railroad vehicle shown in FIG. 1.

Each joining section 31 is designed to be oblong in cross-section in order to have no corners that cause stress concentration in a joining hole of the side beam 12 through which the joining section 31 penetrates. On the other hand, the intermediate section 32 is configured with flat surfaces to facilitate mounting of a motor and others thereon, so that corners are present. Herein, FIG. 2 is a perspective view of a first workpiece pattern of the lateral beam 13. This shows a configuration corresponding to the lateral beam 13 divided into the front-rear direction of the bogie frame, i.e., a pair of lateral-beam members 30 to be welded together to form one lateral beam 13. Each lateral-beam member 30 is made of a steel plate of about 15 mm in thickness by drawing in hot press molding and, as needed, subjected to cutting to arrange the shape.

The lateral-beam member 30 is formed such that each of joining portions 310 corresponding to the joining sections 31 has a U-shaped cross-section with a curved bottom seen in the depth direction M. The intermediate section 32 is formed with shoulder portions 330 in the depth direction M and further with an intermediate portion 320 between the shoulder portions 330. The intermediate portion 320 has an angular U-shaped cross-section with a flat bottom, not a curved bottom. Thus, each shoulder portion 330 has a cross-section changing from the U shape to the angular U shape. The joining portions 310 and the intermediate portion 320 have straight open ends 311 and 321 respectively, and the shoulder portions 330 have curved open ends 331.

The pair of lateral-beam members 30 produced by press molding are arranged such that the open ends 311 of the joining portions 310 are placed in contact with each other, so that the open end 321 of the intermediate portion 320 and the open ends 331 of the shoulder portions 330 form the oblong through hole 33 as shown in FIG. 1. To the open end 321 of the intermediate portion 320 and the open ends 331 of the shoulder portions 330, a plate 341 for hole is welded as shown in FIG. 1 to close the openings of the lateral-beam members 30. Further, an oblong cover plate 342 is welded to an open end of each joining section 31. To the lateral-beam members 30 before joined, the reinforcing plates 38 are joined in positions at which load will be exerted when a motor or the like is mounted and a partition plate for forming auxiliary air chambers which will be mentioned later are joined.

Figure 3:
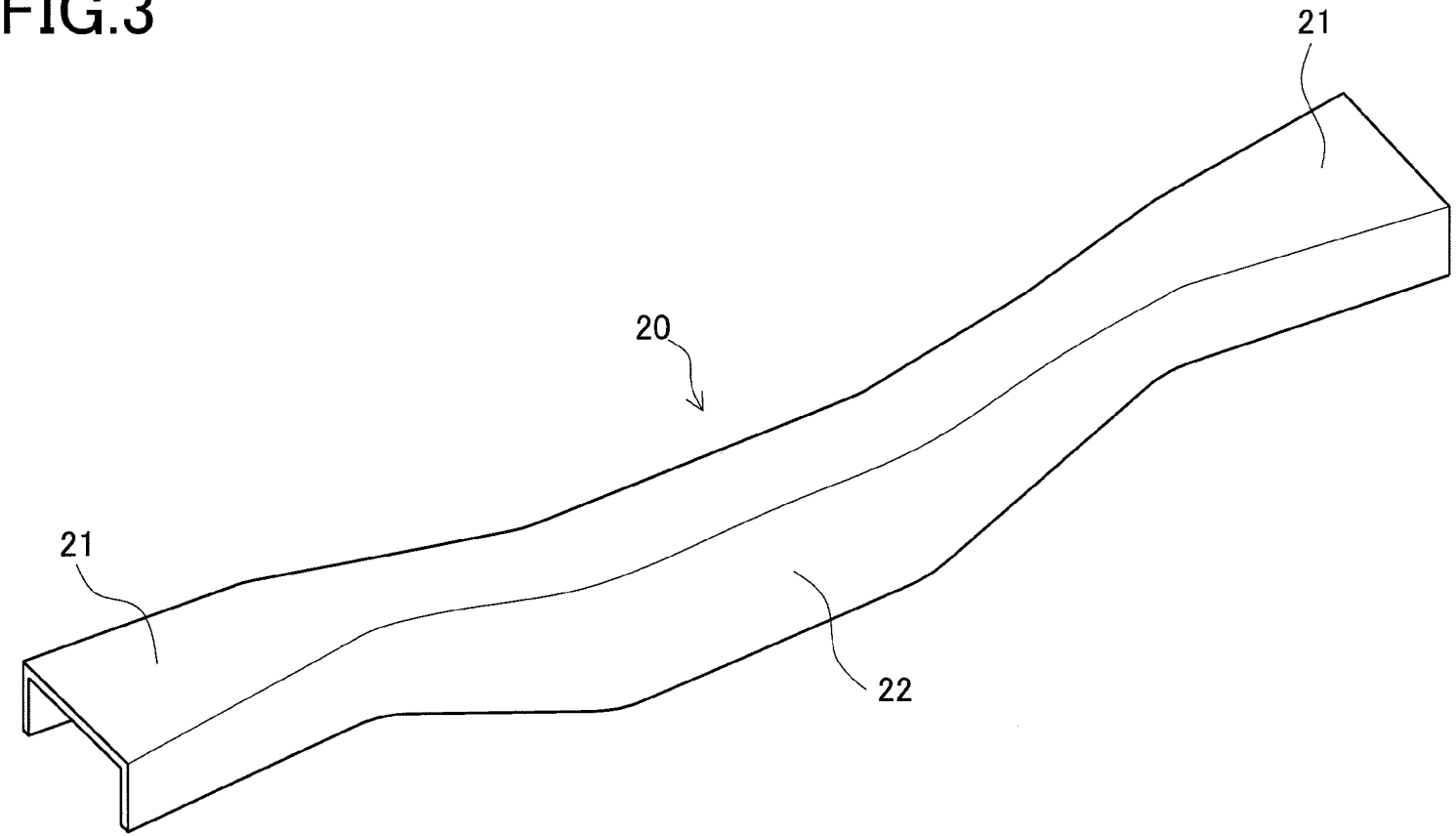
FIG. 3 is a perspective view of a side beam of the bogie frame for railroad vehicle shown in FIG. 1.

FIG. 3 is a perspective view of a side-beam member constituting the side beam 12. The side-beam member 20 is made of a steel plate with about 15 mm in thickness by press molding as with the lateral-beam member 30. The side-beam member 20 is formed, at both ends, with wide spring-cap portions 21 which will be formed as spring caps. An intermediate portion 22 is formed between the spring cap portions 21 located at both ends. This intermediate portion 22 is positioned lower than the spring cap portions 21 by including downward sloping portions. The intermediate portion 22 is smaller in a width direction than the spring cap portions 21 and therefore is larger in a height direction to ensure rigidity even when the lateral beam 13 penetrates through the intermediate portion 22.

The side-beam member 20 has an angular U-shaped cross-section having a lower open end to which a lower plate is welded, resulting in a tubular form. At each end portion of the side-beam member 20 in its longitudinal direction, as shown in FIG. 1, a plate 251 is welded to have beveled corners. Each spring cap portion 21 is formed with a through hole 201 to form a spring cap including the lower plate. The bogie frame 1 consists of the side beams 12 and the lateral beam 13 formed as above. Specifically, the joining sections 31 of the lateral beam 13 are inserted in the oblong through holes formed in the intermediate portions 22 of the side beams 12 and joining portions are welded along the oblong shape to the side beams 12.

Figure 4:
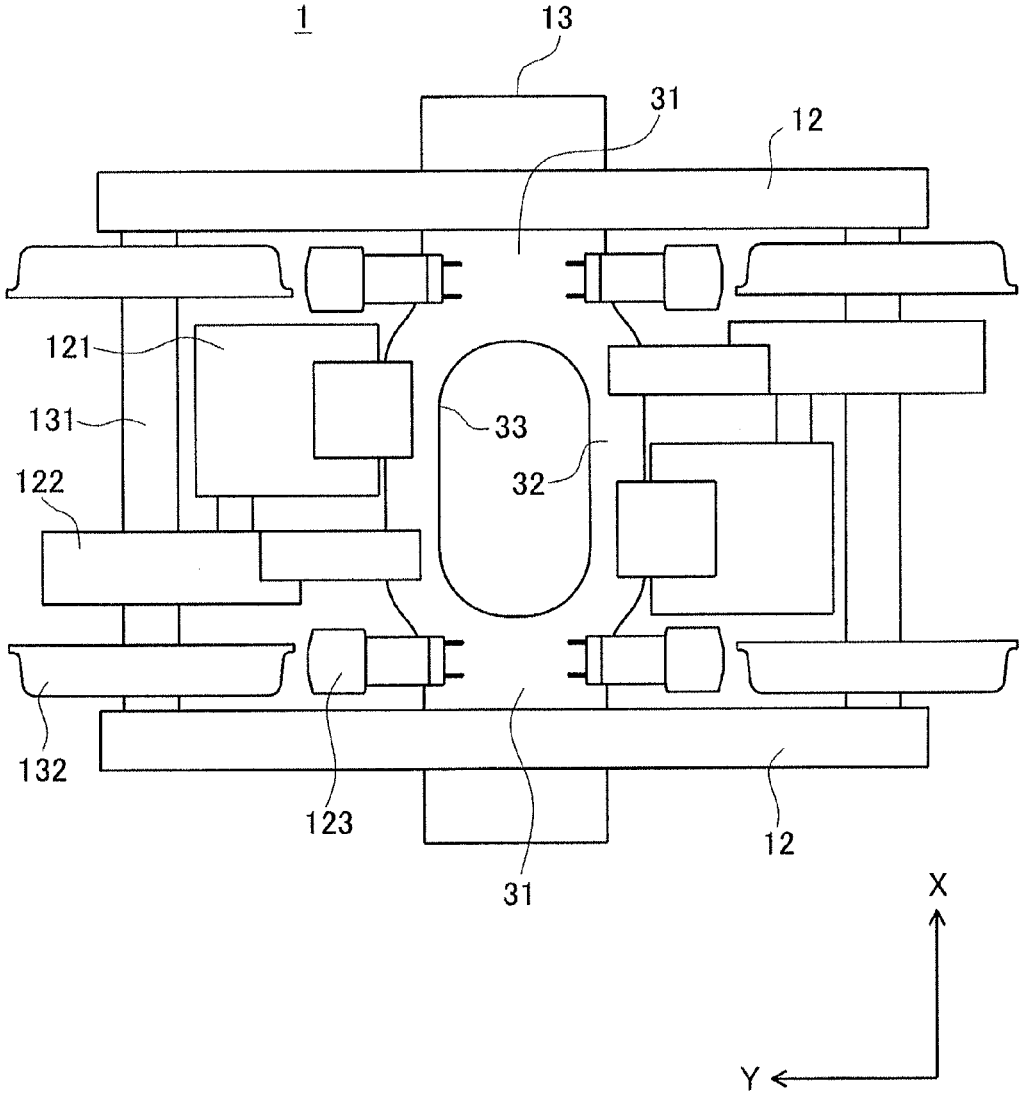
FIG. 4 is a simplified plan view showing a state where a motor and a unit brake are mounted on the bogie frame shown in FIG. 1.

Herein, FIG. 4 is a simplified plan view showing a state where a motor and a unit brake are mounted on the bogie frame 1. Specifically, a motor 121 and a unit brake 123 are mounted on the intermediate section 32 and the joining section 31 of the lateral beam 13, respectively. The intermediate section 32 protruding in the front-rear direction (the Y direction) than the joining sections 31 is closer to the axle 131. Accordingly, the motor 121 mounted on the intermediate section 32 and the gear unit 122 mounted on the axle 131 are located close to each other. On the other hand, the joining section 31 of the lateral beam 13 is recessed in the front-rear direction than the intermediate section 32, thus ensuring a wide space to mount the unit brake 123. Accordingly, this bogie frame 1 can eliminate the need to adjust the position of the motor 121 in the front-rear direction with a bracket to mount the motor 121. Further, this wide space allows the unit 123 to be mounted with high flexibility.

Further, the bogie frame 1 including the lateral beam 13 formed as a single component can achieve a reduced amount of material, and thus weight and cost can be reduced by just that much. The lateral beam 13 is made in such a manner that the lateral-beam members 30 which are halved members are welded to each other. This facilitates a work of inserting a reinforcing member before joining. Welded portions of the lateral-beam members 30 separated in the front-rear direction are located in the upper and lower flat surfaces of the completed lateral beam 13. Thus, stress caused by bending or twisting does not concentrate on the welded portions. Since a single lateral beam 13 is welded to the side beams 12, there is no need to work in a narrow space between two lateral beams. Thus, the lateral beam 13 is easily and reliably welded to the side beams 12.

A center pin not shown for coupling a bogie and a vehicle body is attached by inserting through the through hole 33 of the lateral beam 13. In the through hole 33, a stopper not shown or the like is attached to a side surface of the plate 341 to mechanically stop the vehicle body that vibrates laterally. In this respect, the bogie frame 1 is configured such that the through hole 33 of the lateral beam 13 is oblong, providing a wide area, so that the stopper and others as well as the center pin can be attached to the lateral beam 13 and thus a work thereof is easy.

Figure 5:
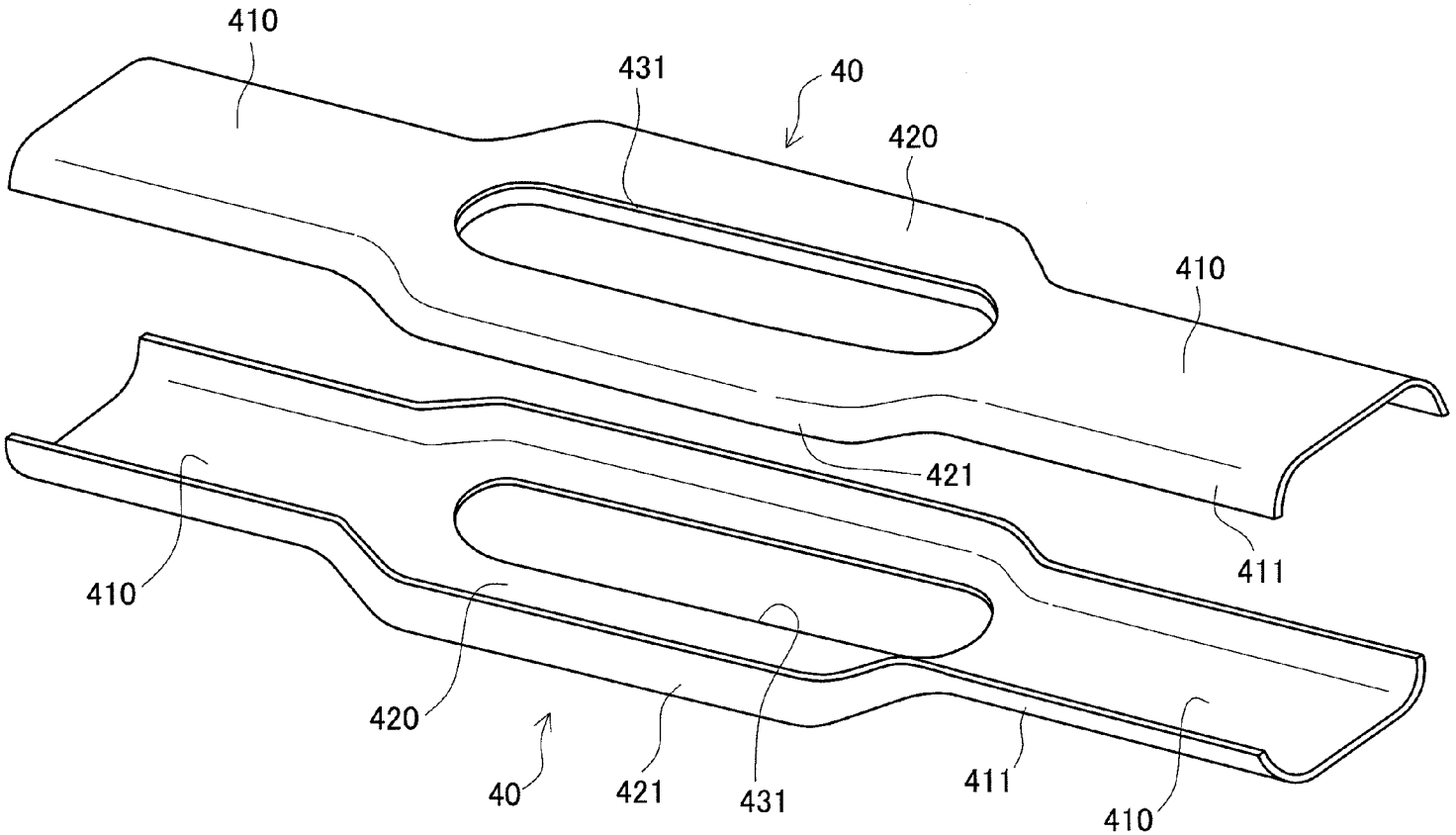
FIG. 5 is a perspective view of a second workpiece pattern of a lateral beam of the bogie frame for railroad vehicle shown in FIG. 1.

FIG. 5 is a perspective view of a second workpiece pattern of the lateral beam 13. This shows a configuration corresponding to the lateral beam 13 divided into the top-bottom direction, i.e., a pair of lateral-beam members 40 to be welded to form one lateral beam 13. Each lateral-beam member 40 is also made of a steel plate by press molding.

Each lateral-beam member 40 includes joining portions 410 corresponding to the joining sections 31 of the lateral beam 13 and an intermediate portion 420 corresponding to the intermediate section 32. The intermediate portion 420 is wider than the joining portions 410 and is formed at its center with an oblong through hole 431. Edge portions 411 of each joining portion 410 are smoothly curved, whereas edge portions 421 of the intermediate portion 420 are flat.

The pair of lateral-beam members 40 are overlaid one on the other and their contact portions are welded to each other. At that time, a reinforcing plate or a partition plate for an auxiliary air chamber is provided in the lateral-beam members 40 as needed. Thereafter, the plate 341 is welded along the oblong shape of the through hole 431 as shown in FIG. 1, the oblong closing plates 342 are welded to the ends of the joining portions 410 to close their openings. In this way, a single lateral beam 13 shown in FIG. 1 is completed.

The second workpiece pattern in which the lateral beam 13 is formed as a single component can achieve a reduced amount of material, and thus weight and cost of the bogie frame 1 can be reduced. Further, the lateral beam 13 is designed so that a reinforcing member or the like can be added to the lateral-beam members 40 which are halved members by an easy attachment work. Welded portions of the lateral-beam members 40 separated in the top-bottom direction are located in a curved surface or a flat surface of the completed lateral beam 13, not in a corner. Thus, stress caused by bending or twisting does not concentrate on the welded portions.

Figure 6:
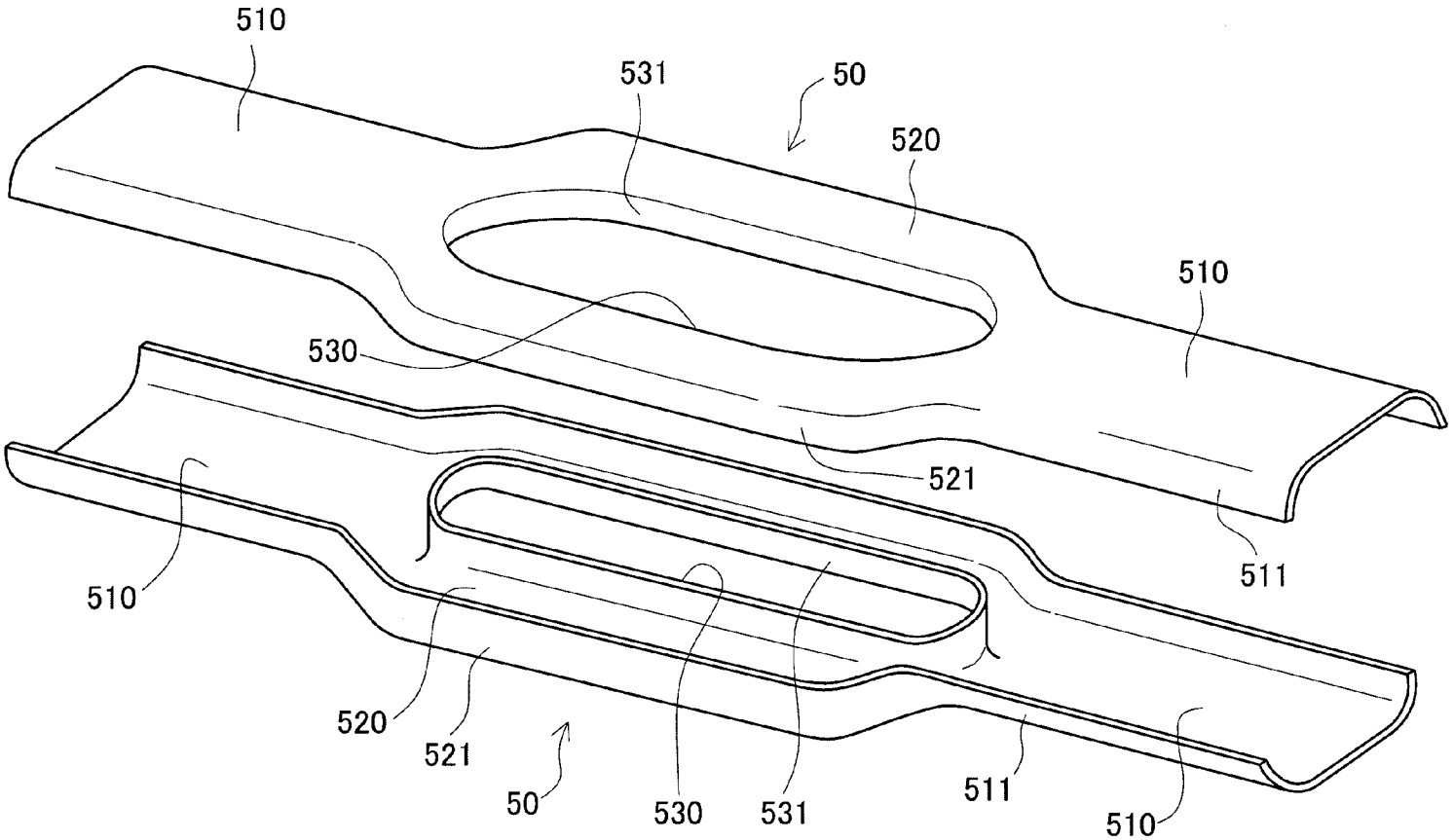
FIG. 6 is a perspective view of a third workpiece pattern of a lateral beam of the bogie frame for railroad vehicle shown in FIG. 1.

FIG. 6 is a perspective view of a third workpiece pattern of the lateral beam 13. This shows a configuration corresponding to the lateral beam 13 divided into the top-bottom direction, as with the second workpiece pattern, i.e., a pair of lateral-beam members 50 to be welded to form one lateral beam 13. The lateral-beam members 50 are also made of a steel plate by press molding.

Each lateral-beam member 50 includes joining portions 510 corresponding to the joining sections 31 of the lateral beam 13 and an intermediate portion 520 corresponding to the intermediate section 32. The intermediate portion 520 is wider than the joining portions 510 and is formed at its center with an oblong through hole 530. Each lateral-beam member 50 includes bent edge portions 511, 521, and 531 in both end portions in a width direction and a circumferential edge of the through hole 530. The edge portions 511 of each joining portion 510 are smoothly curved, whereas the edge portions 521 of the intermediate portion 520 and the edge portions 531 of the through holes 530 are flat.

The pair of lateral-beam members 50 are overlaid one on the other and their contact portions are welded to each other. At that time, the upper and lower edge portions 531 of the through holes 530 are welded to each other, thus forming a configuration corresponding to the plate 341 shown in FIG. 1. When the lateral-beam members 50 are to be welded to each other, a reinforcing plate or a partition plate for an auxiliary air chamber is added in the lateral-beam members 50 as needed. Further, the oblong closing plates 342 are welded to the ends of the joining portions 510 to close their openings. In this way, a single lateral beam 13 shown in FIG. 1 is completed.

The third workpiece pattern in which the lateral beam 13 is formed as a single component can also achieve a reduced amount of material, and thus weight and cost of the bogie frame 1 can be reduced. Further, the lateral beam 13 is designed so that a reinforcing member or the like can be added to the lateral-beam members 50 which are halved members by an easy attachment work. Welded portions of the lateral-beam members 50 separated in the top-bottom direction are located in a curved surface or a flat surface of the completed lateral beam 13, not in a corner. Thus, stress caused by bending or twisting does not concentrate on the welded portions. Further, since the edge portions 531 are formed in the circumferential edges of the through holes 530, they serve as the plate 341. Thus, the number of works can be reduced.

The bogie frame 1 is provided with spring retainers 85 for mounting air springs on the joining sections 31 of the lateral beam 13 penetrating though the side beams 12 as shown in FIG. 1. The internal space of the lateral beam 13 thus serves as an auxiliary air chamber and is communicated with the insides of the air springs attached to the spring retainers 85. Accordingly, the air springs can have an apparently increased volume by the auxiliary air chamber. A throttle valve is placed between the auxiliary air chamber and each air spring to exhibit a viscose damping property. In the lateral beam 13, two partitioned auxiliary air chambers are provided for the right and left air springs. Specifically, a partition plate is welded to one of the lateral-beam members 30, 40, or 50 in advance. When the lateral-beam member 30, 40, or 50 with the partition plate is welded together with the other lateral-beam member 30, 40, or 50, the auxiliary air chambers located on the right side and the left side of the bogie frame 1 can be easily formed.

Figure 7:
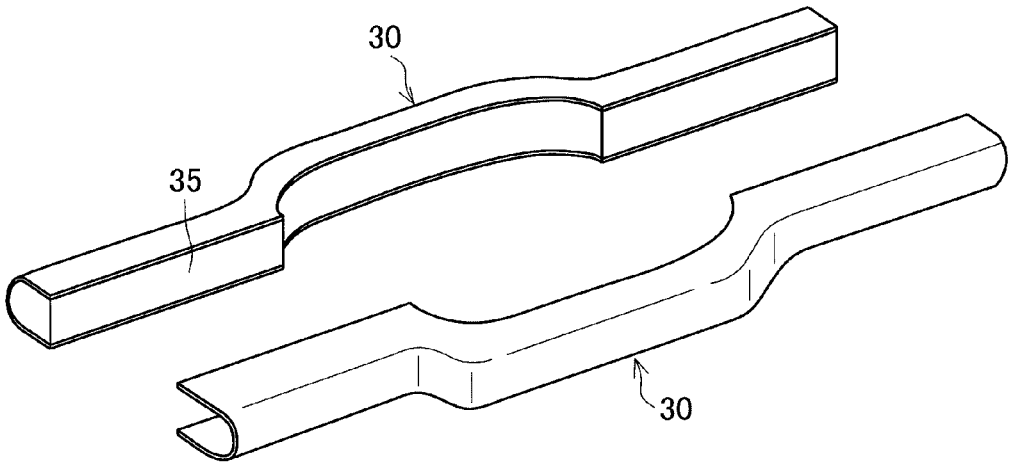
FIG. 7 is a perspective view showing a state where a partition plate for an auxiliary is chamber are attached in a lateral-beam member of the first workpiece pattern shown in FIG. 2.
Figure 8:
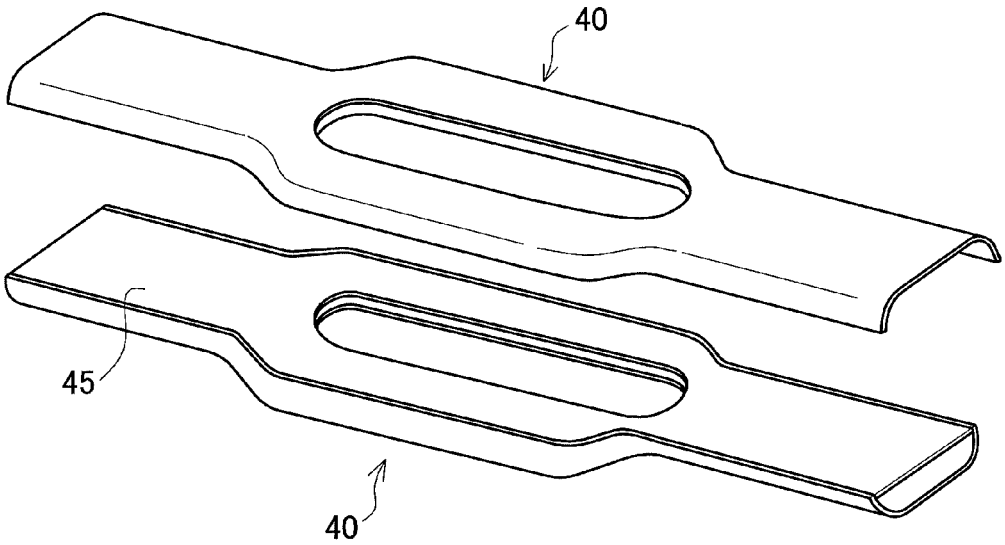
FIG. 8 is a perspective view showing a state where a partition plate for an auxiliary air chamber is attached in a lateral-beam member of the second workpiece pattern shown in FIG. 5.

For instance, the auxiliary air chambers are not only simply partitioned into right and left chambers but also partitioned as shown in FIG. 7 when the lateral beam 13 consists of the lateral-beam members 30 shown in FIG. 2. Specifically, an opening of one of the lateral-beam members 30 is closed in advance by a partition plate 35, and then the lateral-beam members 30 are mated and welded together to each other, thereby forming auxiliary air chambers partitioned in the front-rear direction. Furthermore, when the lateral beam 13 consists of the lateral-beam members 40 shown in FIG. 5 (the same applies to the lateral-beam members 50 shown in FIG. 6), the auxiliary air chambers are partitioned as shown in FIG. 8. Specifically, an opening of the one lateral-beam member 40 is closed in advance by a partition plate 45, and then the lateral-beam members 40 are mated and welded together to each other, thereby forming auxiliary air chambers partitioned in the top-bottom direction. When the upper and lower auxiliary air chambers are provided as shown in FIG. 8, the lower auxiliary air chamber is communicated with the air spring with a pipe not shown formed through the partition plate 45.

(Second Embodiment)

Meanwhile, bogie configurations are different between railroad vehicles according to the types of vehicles. Thus, mounting height of each device such as a motor and a unit brake is also different. When a conventional bogie is changed in design to the bogie frame 1 shown in FIG. 1, each device such as a motor may not be directly mounted. In particular, since the motor 121 is placed close to the gear unit 122 by the intermediate section 32 of the lateral beam 13, it is difficult to adjust the height position of the motor 121 with use of a short bracket for motor connection. On the other hand, to reduce a manufacturing cost, existing devices are requested to be used without change. Thus, it is not preferable to replace the devices according to design changes of the bogie frame.

Therefore, it is conceivable to change the joining position of the lateral beam 13 to the side beams 12 in the bogie frame 1 in the first embodiment. However, if the height position of the lateral beam 13 is changed, the through holes of the side beams 12 are made too close to upper surfaces or lower surfaces of the side beams 12, which may cause strength degradation of the bogie frame 1 or other problems. That is, in the case of the bogie frame 1, the flexibility of changing the joining position of the lateral beam 13 in the vertical direction is very small. On the other hand, if the height of the intermediate portion 22 of each side beam 12 is increased in order to enhance the flexibility of the joining position, the bogie weight will be increased. If the position of each side beam 12 in the vertical direction is changed, other design changes are required.

Figure 9:
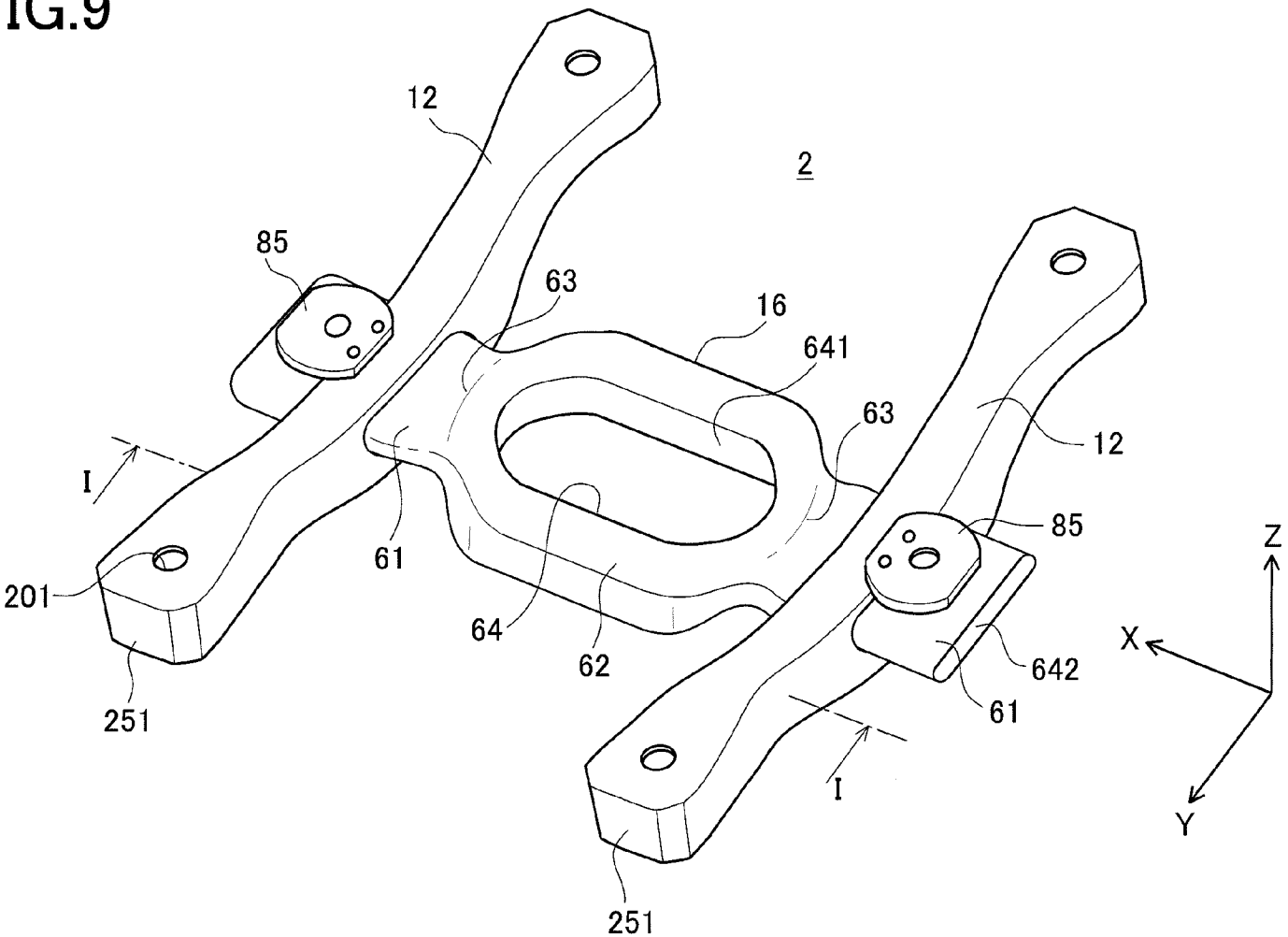
FIG. 9 is a perspective view of a bogie frame for railroad vehicle in a second embodiment.

Therefore, a bogie frame adaptable to existing devices while keeping the effects of the lateral beam disclosed in the first embodiment is proposed below. FIG. 9 is a perspective view of a bogie frame in a second embodiment and similar or identical parts to those in the first embodiment are explained with the same reference signs as those in the first embodiment. This bogie frame 2 is configured so that a lateral beam 16 penetrates through two right and left side beams 12 and is integrally welded thereto and designed to increase the flexibility of the joining positions of the lateral beam 16 to the side beams 12. The lateral beam 16 consists of right and left joining sections 61 each having a flattened shape in cross-section when seen from a longitudinal direction (the X direction), the joining sections 61 penetrating through the side beams 12, and an intermediate section 62 having an oblong through hole 64. When seen from the front-rear direction (the Y direction), each joining section 61 has a smoothly curved edge and the intermediate section 62 has a flat edge.

Figure 10:
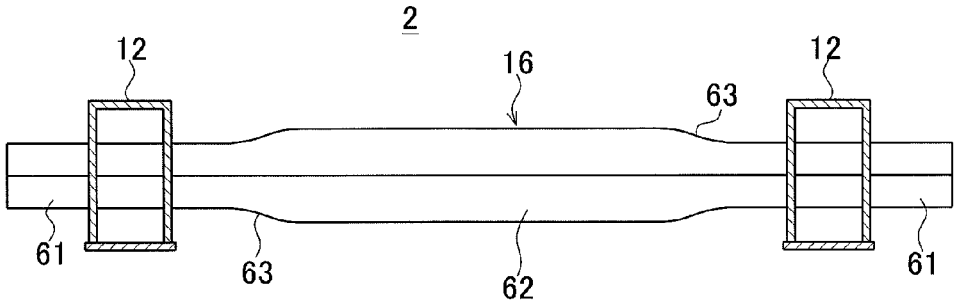
FIG. 10 is a side view of a lateral beam taken along a line I-I in FIG. 9.

FIG. 10 is a side view of the lateral beam 16 taken along a line I-I in FIG. 9. The lateral beam 16 has upper and lower surfaces changing through shoulder portions 63 sloping from the intermediate section 62 to the joining sections 61 as shown in the figure. Specifically, each joining section 61 is smaller in thickness than the intermediate section 62 so that each joining section 61 has a thin shape constricted in the vertical direction. The thus designed lateral beam 16 is produced, for example, in such a manner that a pair of lateral-beam members as in FIG. 5 are made by press molding, and then overlapped one on the other and welded together. At that time, reinforcing members or partition plates for auxiliary air chambers or the like are added to the lateral-beam members as needed. In a portion corresponding to the through hole 64, a plate 641 is welded along the oblong shape as shown in FIG. 9 and further oblong closing plates 642 are welded to both ends of the joining sections 61, thereby closing their openings. Thus, the lateral beam 16 is completed as a single component.

Figure 11:
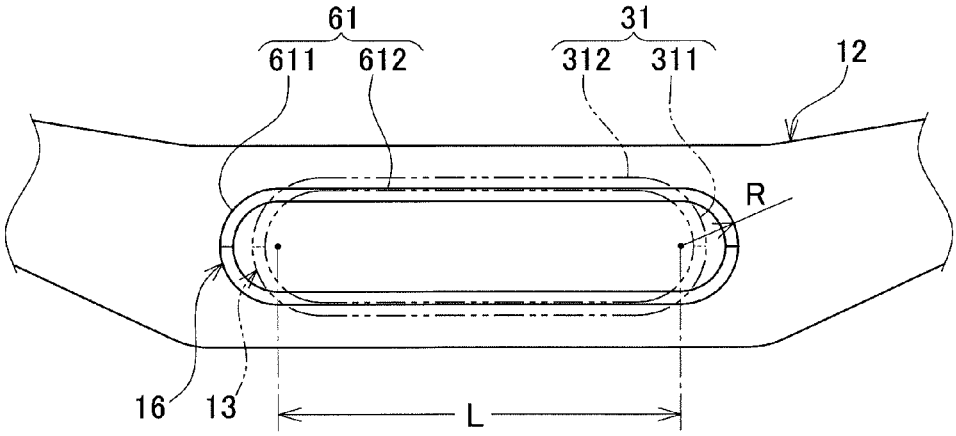
FIG. 11 is a view showing a joining portion between the side beam and a lateral beam in the bogie frame in the second embodiment.

FIG. 11 is a side view of a joining portion between one side beam 12 and the lateral beam 16, seen from the X direction in FIG. 9. Herein, the lateral beam 13 of the first embodiment is indicated by a chain double-dashed line. As seen from this figure, each joining section 61 of the lateral beam 16 is designed to be wider than the joining sections 31 of the lateral beam 13 and accordingly to be thinner in thickness in the vertical direction than the joining sections 31. The lateral beam 16 having the thinner joining sections 61 enables displacement of the joining positions to the side beams 12 in a wider range as compared with the lateral beam 13. On the other hand, the joining sections 61 being thinner in thickness are larger in the width direction than the joining sections 31 to prevent decrease in strength.

One example of concrete sizes of the lateral beams 13 and 16 is shown. The lateral beams 13 and 16 are made of 15-mm thickness steel plates by press molding. Each joining section 61 of the lateral beam 16 is of an oblong shape including semi-circular portions 611 at both ends and straight portions 612 joining between the semi-circular portions 611. A radius R of each semi-circular portion 611 is 67.6 mm and a length L of each straight portion 612 is 465 mm. On the other hand, In the joining section 31 of the lateral beam 13, each semi-circular portion 311 has a radius of 82.6 mm and each straight portion 312 has a length of 365 mm. Accordingly, the joining section 61 is thinner in thickness by 30 mm and longer in width by 70 mm than the joining section 31.

Accordingly, the lateral beam 16 having the thin joining sections 61 allows displacement of the joining positions to the side beams 12 in the vertical direction. When the bogie frame 2 with a joining height of the lateral beam 16 determined according to each vehicle is manufactured, existing devices can be used without changes, thus resulting in cost reduction. The lateral beam 16 can also provide the same effects as with the lateral beam 13 of the first embodiment. For example, the intermediate section 62 allows the motor 121 and the gear unit 122 (see FIG. 4) to be mounted in close positions. The joining sections 61 provide wide space for mounting the unit brakes 123 (see FIG. 4). Since each joining section 61 is designed to have a large width, a modulus of section of each joining section 61 is approximately equal to the value of each joining section 31 of the first embodiment, thereby ensuring necessary strength.

(Third Embodiment)

The lateral beam 16 of the second embodiment is made in such a manner that symmetrical upper and lower lateral-beam members are made by press molding as with those shown in FIG. 5, and then overlaid one on the other. This configuration needs only one kind of a mold. Instead of such a configuration, the invention may be applied to other configurations including asymmetrical upper and lower lateral-beam members.

Figure 12:
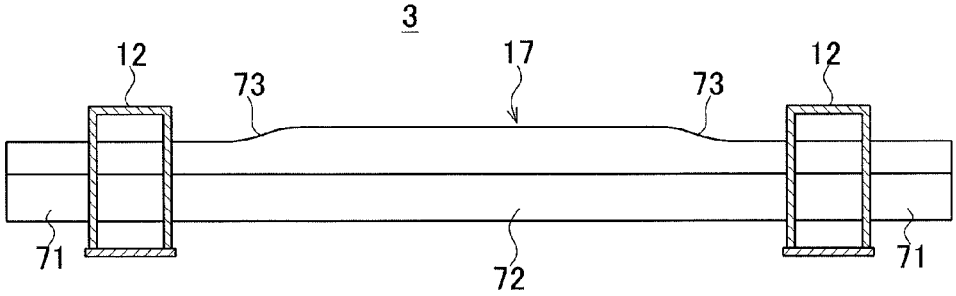
FIG. 12 is a side view of a lateral beam of a bogie frame for railroad vehicle in a third embodiment, corresponding to the I-I section in FIG. 9.

FIG. 12 is a side view of a lateral beam of a bogie frame of a third embodiment, taken along the line I-I in FIG. 9 as with FIG. 10. The side beams 12 are similar in configuration to those in the aforementioned embodiments and thus a drawing of the entire bogie frame is omitted, and hence FIG. 12 shows a side view of the lateral beam 17 which is a characteristic portion. The lateral beam 17 of the bogie frame 3 consists of asymmetric upper and lower parts; the lower part has the same shape as the lateral beam 13 of the first embodiment and the upper part has the same shape as with the lateral beam 16 of the second embodiment. Specifically, an upper surface of the lateral beam 17 changes through shoulder portions 73 sloping from an intermediate section 72 to joining sections 71 so that the thickness of each joining section 71 is made thinner.

Accordingly, in correspondence with a space generated on the joining sections 71 made thinner, the joining positions of the lateral beam 17 to the side beams 12 can be displaced to a more upper position. Thus, when the bogie frame 3 is manufactured with the lateral beam 17 joined at a position determined according to each vehicle, existing devices can be used without changes, resulting in cost reduction. This lateral beam 17 can also provide the same effects as with the lateral beam 13 of the first embodiment in mounting the motor 121 and the unit brake 123 (see FIG. 4) to the intermediate section 72 and the joining sections 71. The bogie frame 3 is configured so that the joining position of the lateral beam 17 is changed to a higher position. Alternatively, to change the joining position to a lower position, the lateral beam 17 may simply be reversed upside down.

(Fourth Embodiment)

Figure 13:
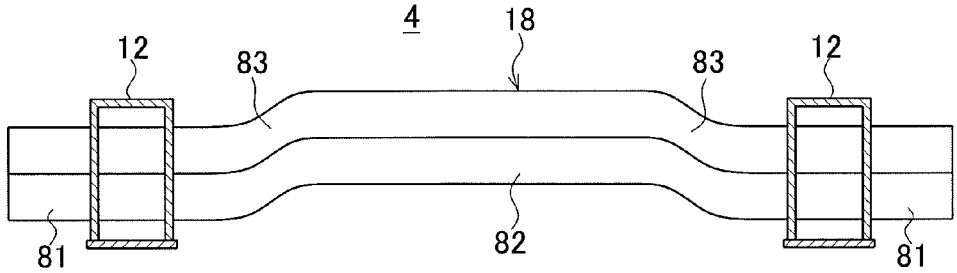
FIG. 13 is a side view of a lateral beam of a bogie frame for railroad vehicle in a fourth embodiment, corresponding to the I-I section in FIG. 9.

In the case of the upper and lower asymmetric configuration, a lateral beam may be formed with shoulder portions as shown in FIG. 13. FIG. 13 is a side view of a lateral beam of a bogie frame of a fourth embodiment, taken along the line I-I in FIG. 9 as with FIG. 10. The side beams 12 are similar in configuration to those in the aforementioned embodiments and a drawing of the entire bogie frame is omitted, and FIG. 13 shows a side view of a lateral beam 18 which is a characteristic portion. The lateral beam 18 of the bogie frame 4 includes upper and lower surfaces similarly changing through shoulder portions 83 sloping from joining sections 81 to an intermediate section 82 so that the position of the intermediate section 82 is located in a position higher than the joining sections 81. The joining sections 81, the intermediate section 82, and the shoulder portions 83 have a nearly equal thickness.

The bogie frame 4 of the present embodiment is configured so that the height position of the intermediate section 82 is adjusted by an inclination of each shoulder portion 83 without displacing the joining positions of the lateral beam 18. Accordingly, when the bogie frame 4 is manufactured with the lateral beam 18 designed according to each vehicle, existing devices can be used without changes, resulting in cost reduction. The lateral beam 18 can also provide the same effects as with the lateral beam 13 of the first embodiment in mounting the motor 121 and the unit brake 123 (see FIG. 4) to the intermediate section 82 or the joining sections 81. The bogie frame 4 is configured so that the mounting position of a motor and others to the lateral beam 18 is changed to a higher position. Alternatively, to change the joining position to a lower position, the lateral beam 18 may simply be reversed upside down.

(Fifth Embodiment)

Figure 14:
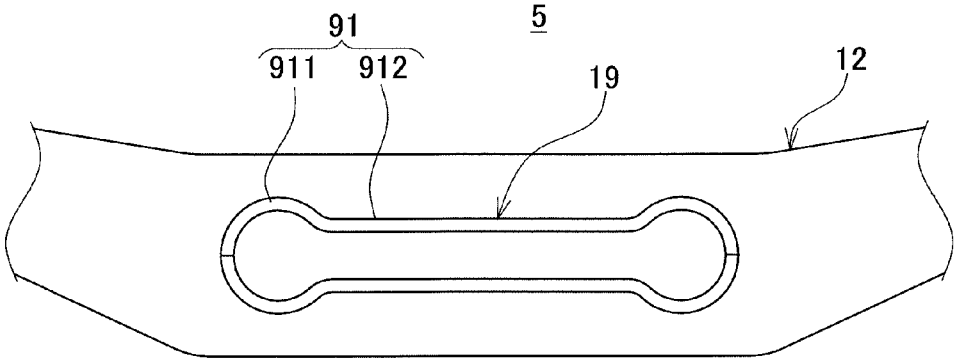
FIG. 14 is a view showing a joining portion between a side beam and a lateral beam in a bogie frame for railroad vehicle in a fifth embodiment.
Figure 15:
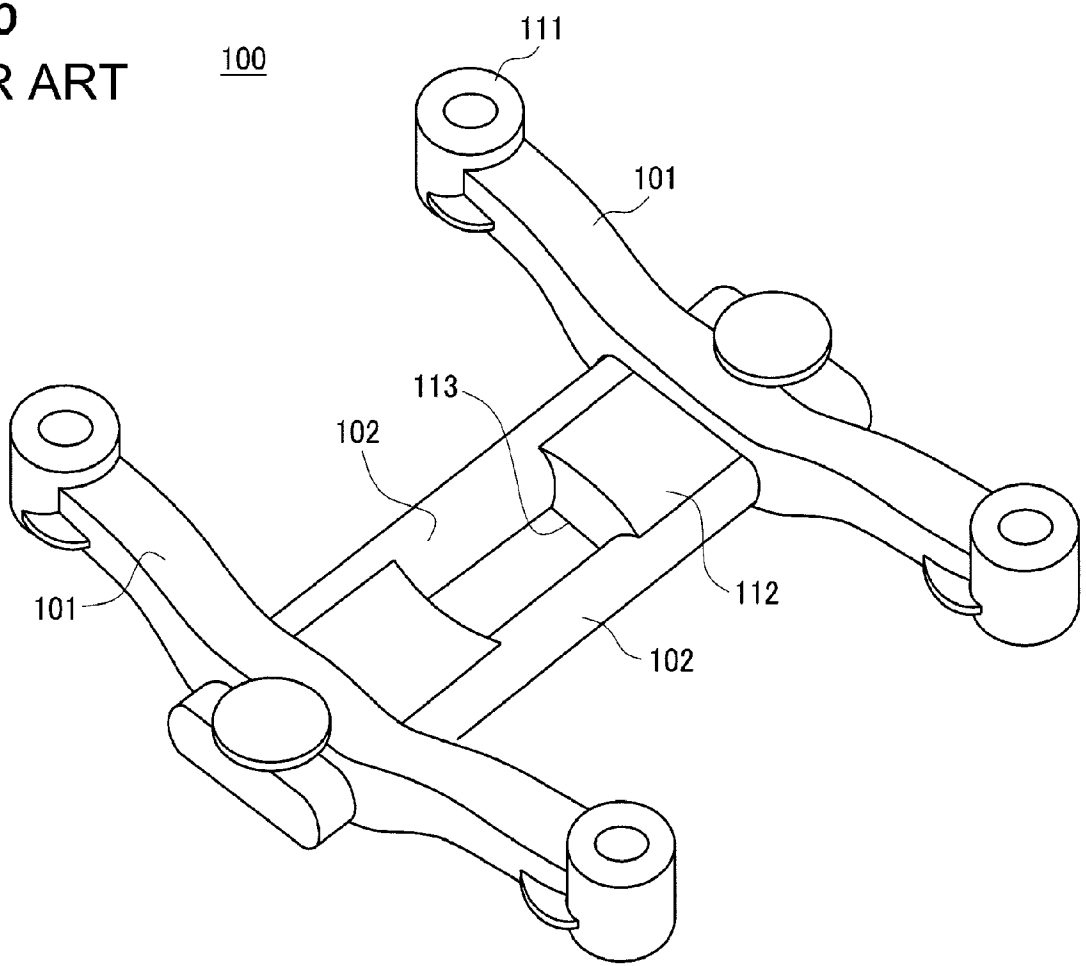
FIG.15 PRIOR ART
FIG. 15 is a view of a conventional bogie frame for railroad vehicle.
Figure 16:
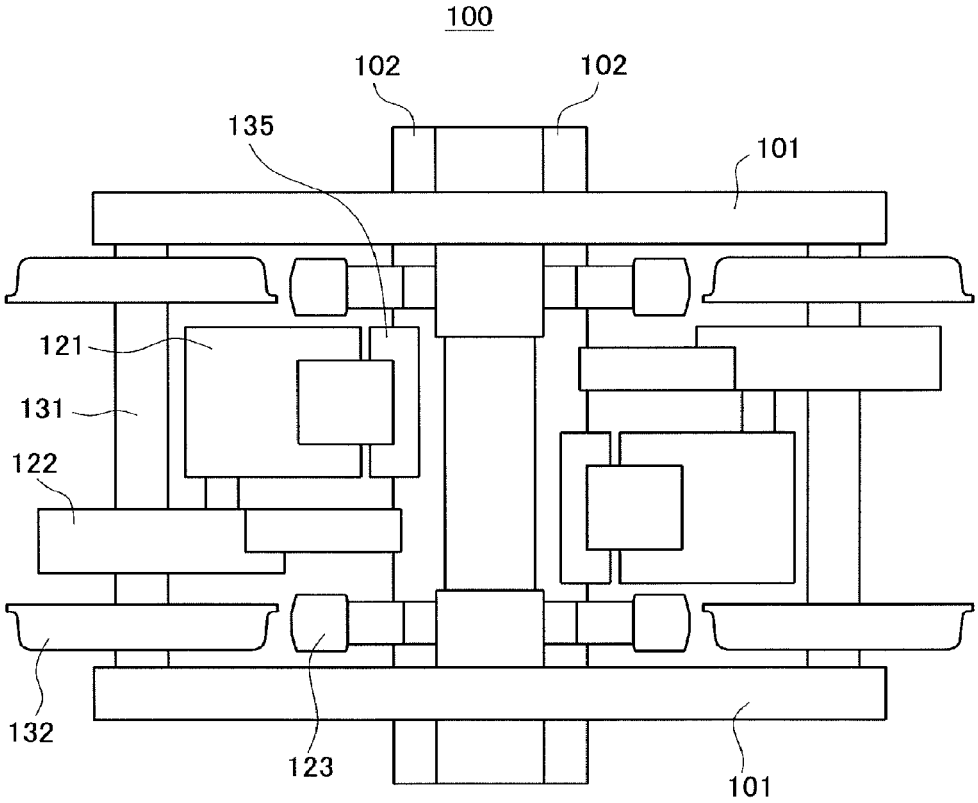
FIG.16 PRIOR ART
FIG. 16 is a simplified plan view showing a state where a motor and a unit brake are mounted on the conventional bogie frame.

Meanwhile, in the second embodiment, the lateral width is made larger in association with the vertical thickness is made thinner as shown in FIG. 11 to ensure necessary strength. In consideration of the modulus of section, the cross sectional shape of each joining section may be changed to increase a geometric moment of inertia. Specifically, each joining section 91 of a lateral beam 19 is formed to have such a cross-section as shown in FIG. 14. In a bogie frame 5 of the fifth embodiment, to be specific, circular portions 911 each having a larger diameter than a straight portion 912 are formed at both ends of the straight portion 912.

Accordingly, the lateral beam 19 enables displacement of the joining height with respect to the side beams 12 in the top-bottom direction in correspondence with the thin thickness of the joining sections 91. When the bogie frame 5 is manufactured with the lateral beam 19 having a joining height determined according to each vehicle, existing devices can be used without changes, resulting in cost reduction.

The bogie frame of the present invention is explained in the above embodiments, but is not limited thereto. The invention may be embodied in other specific forms without departing from the essential characteristics thereof.

In the lateral beams 13 and 16 disclosed in the first and second embodiments, the joining sections 31 and 61 are designed to be oblong in cross-section, but may be elliptic or others in cross-section.

Furthermore, the lateral beams 16, 17, 18, and 19 in the second through fifth embodiments are configured by assembling the upper and lower lateral-beam members separated in the top-bottom direction. As shown in FIG. 2 of the first embodiment, alternatively, the lateral beam may be configured by assembling the front and rear lateral-beam members separated in the front-rear direction.

The invention claimed is:

1. A bogie frame for railroad vehicle, wherein a single lateral beam placed to extend in a left-right direction along a rail-tie so that a motor and brakes are to be mounted on the lateral beam is joined to right and left side beams arranged to extend in a front-rear direction along a rail, the lateral beam includes right and left joining sections joined to the side beams by penetrating through the side beams and an intermediate section provided between the joining sections, each of the joining sections and the intermediate section having a flattened shape having a width in the front-rear direction larger than a thickness in a top-bottom direction, the intermediate section being formed with an oblong through hole at a center, each joining section has curved end faces located in the front-rear direction, and the intermediate section has flat end faces located in the front-rear direction and a flat wall defining the through hole, and the intermediate section is formed to be wider in the front-rear direction than the joining sections to avoid the necessity of adjusting a position of the motor in the front-rear direction with a bracket when the motor is to be mounted on the intermediate section and coupled to an axle through a gear unit, and the joining sections have a size in the left-right direction to allow mounting of the brakes inside the side beams.

2. The bogie frame for railroad vehicle according to claim 1, wherein the lateral beam is configured such that each joining section has a thickness in the top-bottom direction smaller than that of the intermediate section.

3. The bogie frame for railroad vehicle according to claim 2, wherein the lateral beam has upper and lower surfaces each changing through shoulder portions each sloping from the intermediate section to the joining sections so that the upper surface and the lower surface are symmetric.

4. The bogie frame for railroad vehicle according to claim 2, wherein the lateral beam has upper and lower surfaces, one of the surfaces changing through shoulder portions each sloping from the intermediate section to the joining sections so that the upper surface and the lower surface are asymmetric.

5. The bogie frame for railroad vehicle according to claim 2, wherein each joining section has end portions in the front-rear direction, each end portion being formed as a circular portion having a diameter larger than the thickness of a portion located between the end portions.

6. The bogie frame for railroad vehicle according to claim 1, wherein the lateral beam is formed with sloping shoulder portions between the intermediate section and the joining sections so that the intermediate section and the joining sections are different in height in the top-bottom direction.

7. The bogie frame for railroad vehicle according to claim 1, wherein the lateral beam includes a pair of lateral-beam members made of steel plates by press molding, the lateral-beam members being configured as two parts separated in the front-rear direction or in the top-bottom direction and integrally joined to each other by welding.

8. The bogie frame for railroad vehicle according to claim 7, wherein a partition plate is welded to the lateral-beam member, and auxiliary air chambers for air springs to be placed on right and left sides of the bogie frame.

9. The bogie frame for railroad vehicle according to claim 2, wherein the lateral beam includes a pair of lateral-beam members made of steel plates by press molding, the lateral-beam members being configured as two parts separated in the top-bottom direction and integrally joined to each other by welding.

10. The bogie frame for railroad vehicle according to claim 3, wherein the lateral beam includes a pair of lateral-beam members made of steel plates by press molding, the lateral-beam members being configured as two parts separated in the top-bottom direction and integrally joined to each other by welding.

11. The bogie frame for railroad vehicle according to claim 4, wherein the lateral beam includes a pair of lateral-beam members made of steel plates by press molding, the lateral-beam members being configured as two parts separated in the top-bottom direction and integrally joined to each other by welding.

12. The bogie frame for railroad vehicle according to claim 5, wherein the lateral beam includes a pair of lateral-beam members made of steel plates by press molding, the lateral-beam members being configured as two parts separated in the top-bottom direction and integrally joined to each other by welding.

13. The bogie frame for railroad vehicle according to claim 6, wherein the lateral beam includes a pair of lateral-beam members made of steel plates by press molding, the lateral-beam members being configured as two parts separated in the top-bottom direction and integrally joined to each other by welding.

14. The bogie frame for railroad vehicle according to claim 9, wherein a partition plate is welded to the lateral-beam member, and auxiliary air chambers for air springs to be placed on right and left sides of the bogie frame.

15. The bogie frame for railroad vehicle according to claim 10, wherein a partition plate is welded to the lateral-beam member, and auxiliary air chambers for air springs to be placed on right and left sides of the bogie frame.

16. The bogie frame for railroad vehicle according to claim 11, wherein a partition plate is welded to the lateral-beam member, and auxiliary air chambers for air springs to be placed on right and left sides of the bogie frame.

17. The bogie frame for railroad vehicle according to claim 12, wherein a partition plate is welded to the lateral-beam member, and auxiliary air chambers for air springs to be placed on right and left sides of the bogie frame.

18. The bogie frame for railroad vehicle according to claim 13, wherein a partition plate is welded to the lateral-beam member, and auxiliary air chambers for air springs to be placed on right and left sides of the bogie frame.

* * * * *